US006361392B2

(12) United States Patent
Moradi et al.

(10) Patent No.: US 6,361,392 B2
(45) Date of Patent: Mar. 26, 2002

(54) EXTRACTION GRID FOR FIELD EMISSION DISPLAYS AND METHOD

(75) Inventors: Behnam Moradi; Tianhong Zhang, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/860,256

(22) Filed: May 18, 2001

Related U.S. Application Data

(62) Division of application No. 09/126,494, filed on Jul. 29, 1998, now Pat. No. 6,278,229.

(51) Int. Cl.[7] ..... H01J 9/02
(52) U.S. Cl. ..... 445/24
(58) Field of Search ..... 445/24; 313/309

(56) References Cited

U.S. PATENT DOCUMENTS

| | | | | |
|---|---|---|---|---|
| 4,422,732 A | * | 12/1983 | Ditzik | 359/315 |
| 5,151,061 A | | 9/1992 | Sandhu | 445/24 |
| 5,186,670 A | | 2/1993 | Doan et al. | 445/24 |
| 5,210,472 A | | 5/1993 | Casper et al. | 315/349 |
| 5,212,426 A | | 5/1993 | Kane | 315/169.1 |
| 5,319,279 A | | 6/1994 | Watanabe et al. | 313/309 |
| 5,372,973 A | | 12/1994 | Doan et al. | 437/228 |
| 5,410,218 A | | 4/1995 | Hush | 315/169.1 |
| 5,473,222 A | | 12/1995 | Theony et al. | 315/169.1 |
| 5,585,301 A | | 12/1996 | Lee et al. | 437/60 |
| 5,866,979 A | * | 2/1999 | Cathey, Jr. et al. | 313/309 |
| 5,975,975 A | | 11/1999 | Hofmann et al. | 445/24 |
| 6,010,918 A | | 1/2000 | Marino et al. | 438/20 |

OTHER PUBLICATIONS

Chalamala et al., "Fed Up with fat Tubes," *IEEE Spectrum*, pp. 42–51, Apr. 1998.

* cited by examiner

*Primary Examiner*—Kenneth J. Ramsey
(74) *Attorney, Agent, or Firm*—Dorsey & Whitney LLP

(57) ABSTRACT

A display apparatus includes a substrate and a plurality of emitters formed on the substrate. The apparatus also includes a dielectric layer formed on the substrate. The dielectric layer includes a plurality of openings each formed about one of the plurality of emitters. The dielectric layer and extraction grid together have a thickness, measured perpendicular to the substrate, similar to a height of the emitters above the substrate. The apparatus also includes an extraction grid formed on the dielectric layer. The extraction grid is formed substantially in a plane of tips of the plurality of emitters and includes openings each formed about and in close proximity to a tip of one of the plurality of emitters. The extraction grid includes germanium so that photons incident on exposed portions of the extraction grid are absorbed and are not transmitted to depletion regions associated with the emitters. This reduces distortion in operation of the display.

8 Claims, 6 Drawing Sheets

EXTRACTION GRID FOR FIELD EMISSION DISPLAYS AND METHOD

CROSS-REFERENCE TO RELATED APPLICATION

This application is a divisional of pending U.S. patent application Ser. No. 09/126,494, filed Jul. 29, 1998, now U.S. Pat. No. 6,278,229.

GOVERNMENT RIGHTS

This invention was made with government support under Contract No. DABT63-93-C-0025 awarded by Advanced Research Projects Agency (ARPA). The government has certain rights in this invention.

TECHNICAL FIELD

This invention relates in general to visual displays for electronic devices, and in particular to an improved extraction grid for displays.

BACKGROUND OF THE INVENTION

FIG. 1 is a simplified side cross-sectional view of a portion of a display 10 including a faceplate 20 and a baseplate 21 in accordance with the prior art. FIG. 1 is not drawn to scale. The faceplate 20 includes a transparent viewing screen 22, a transparent conductive layer 24 and a cathodoluminescent layer 26. The transparent viewing screen 22 supports the layers 24 and 26, acts as a viewing surface and as a wall for a hermetically sealed package formed between the viewing screen 22 and the baseplate 21. The viewing screen 22 may be formed from glass. The transparent conductive layer 24 may be formed from indium tin oxide. The cathodoluminescent layer 26 may be segmented into pixels yielding different colors for color displays. Materials useful as cathodoluminescent materials in the cathodoluminescent layer 26 include $Y_2O_3$:Eu (red, phosphor P-56), $Y_3(Al, Ga)_5O_{12}$:Tb (green, phosphor P-53) and $Y_2(SiO_5)$:Ce (blue, phosphor P-47) available from Osram Sylvania of Towanda PA or from Nichia of Japan.

The baseplate 21 includes emitters 30 formed on a planar surface of a semiconductor substrate 32. The substrate 32 is coated with a dielectric layer 34. In one embodiment, this is effected by deposition of silicon dioxide via a conventional TEOS process. The dielectric layer 34 is formed to have a thickness, measured in a direction perpendicular to a surface of the substrate 32 as indicated by direction arrow 36, that is less than a height of the emitters 30. An extraction grid 38 comprising a conductive material is formed on the dielectric layer 34. The extraction grid 38 may be realized, for example, as a thin layer of polysilicon. The radius of an opening 40 created in the extraction grid 38, which is also approximately the separation of the extraction grid 38 from the tip of the emitter 30, is about 0.4 microns, although larger or smaller openings 40 may also be employed. This separation is defined herein to mean being "in close proximity."

Another dielectric layer 42 is formed on the extraction grid 38. A chemical isolation layer 44, such as titanium, is formed on the dielectric layer 42. A high atomic mass layer 46, such as tungsten, is formed on the chemical isolation layer 44 for reasons that will be explained below.

The baseplate 21 also includes a field effect transistor ("FET") 50 formed in the surface of the substrate 32 for controlling the supply of electrons to the emitter 30. The FET 50 includes an n-tank 52 formed in the surface of the substrate 32 beneath the emitter 30. The n-tank 52 serves as a drain for the FET 50 and may be formed via conventional masking and ion implantation processes. The FET 50 also includes a source 54 and a gate electrode 56. The gate electrode 56 is separated from the substrate 32 by a gate dielectric 57 and a field oxide layer 58. The opening 40 in the high atomic mass layer 46 is typically about 10 microns in diameter, while the n-tank 52 is typically about 13 microns in diameter. The emitter 30 is typically about a micron wide, and several (e.g., four or five) emitters 30 are included together with each n-tank 52, although only one emitter 30 is illustrated.

The substrate 32 may be formed from p-type silicon material having an acceptor concentration $N_A$ ca. $1–5\times10^{15}/cm^3$, while the n-tank 52 may have a surface donor concentration $N_D$ ca. $1–2\times10^{16}/cm^3$. A depletion region 60 is formed at a p-n junction between the n-tank 52 and the p-type substrate 32.

In operation, the extraction grid 38 is biased to a voltage on the order of 100 volts, although higher or lower voltages may be used, while the substrate 32 is maintained at a negative voltage. Signals coupled to the gate 56 of the FET 50 turn the FET 50 on, allowing electrons to flow from the source 54 to the n-tank 52 and thus to the emitter 30. Intense electrical fields between the emitter 30 and the extraction grid 38 then cause field emission of electrons from the emitter 30. A larger positive voltage, ranging up to as much as 5,000 volts or more but often 2,500 volts or less, is applied to the faceplate 20 via the transparent conductive layer 24. The electrons emitted from the emitter 30 are accelerated to the faceplate 20 by this voltage and strike the cathodoluminescent layer 26. This causes light emission in selected areas, i.e., those areas adjacent to where the FETs 50 are conducting, and forms luminous images such as text, pictures and the like. Integrating the FETs 50 in the substrate 32 to provide an active display 10 (i.e., a display 10 including active circuitry for addressing and providing control signals to specific emitters 30 etc.) yields advantages in size, simplicity and ease of interconnection of the display 10 to other electronic componentry.

Visible photons from the cathodoluminescent layer 26 and photons that travel through the faceplate 20 can also travel back through the openings 40. When photons travel through the portions of the extraction grid 38 exposed by the openings 40 and impinge on the substrate 32, electron-hole pairs are generated. When electron-hole pairs are produced near the p-n junction between the n-tank 52 and the p-type substrate 32, the electrons and holes are efficiently separated by the electrical fields associated with the p-n junction. The electrons are swept into the n-tank 52 and the holes are swept into the p-type substrate 32 surrounding the n-tank 52. The electrons provide an undesirable component to electrons emitted by the emitter 30. This results in distortion in the images produced by the display 10.

For example, a blue pixel emitting blue light could provide a photon that reaches semiconductor material underlying the emitter 30 associated with an adjacent red pixel, which is not intended to be emitting light. This may cause an emitter current component resulting in an anode current in the red pixel, thus providing unwanted red light and thereby distorting the color intended to be displayed.

Alternatively, an area intended to be a dark area in the display 10 may emit light when that area is exposed to high ambient light conditions. These effects are undesirable and tend to reduce display dynamic range in addition to distorting the intended image.

There is therefore a need for a way to shield p-n junctions associated with monolithic emitters for use in field emission displays from photons incident on exposed portions of the extraction grid.

SUMMARY OF THE INVENTION

In accordance with one aspect of the invention, a field emission display includes a substrate, a plurality of emitters formed on the substrate, a semiconductor device formed in or on the substrate for controlling the flow of electrons to the emitters, and a dielectric layer formed on the substrate. The dielectric layer includes an opening formed about each of the emitters. The display also includes an extraction grid formed substantially in a plane of tips of the plurality of emitters and includes openings each formed about and in close proximity to a tip of one of the plurality of emitters. Significantly, the extraction grid is fabricated from germanium.

As a result, the extraction grid has significantly greater optical absorption of light incident on it through openings in the layers on it. This prevents visible photons from traveling through the extraction grid and creating electron-hole pairs in a depletion region associated with the semiconductor device. This reduces distortion in field emission displays.

DETAILED DESCRIPTION OF THE INVENTION

Figure 1:
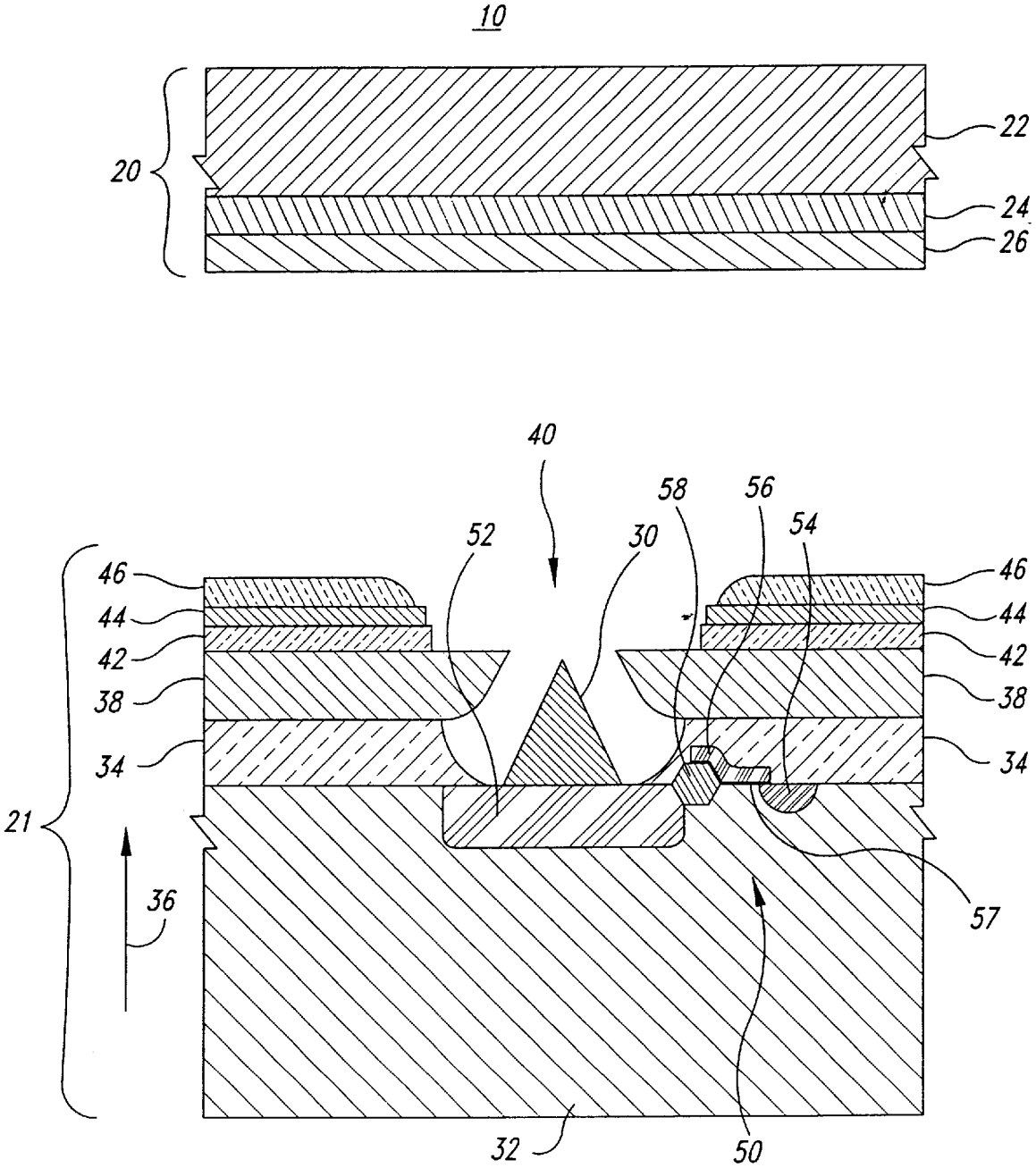
Fig. 1 (PRIOR ART)
FIG. 1 is a simplified side cross-sectional view of a portion of a display including a faceplate and a baseplate in accordance with the prior art.
Figure 2:
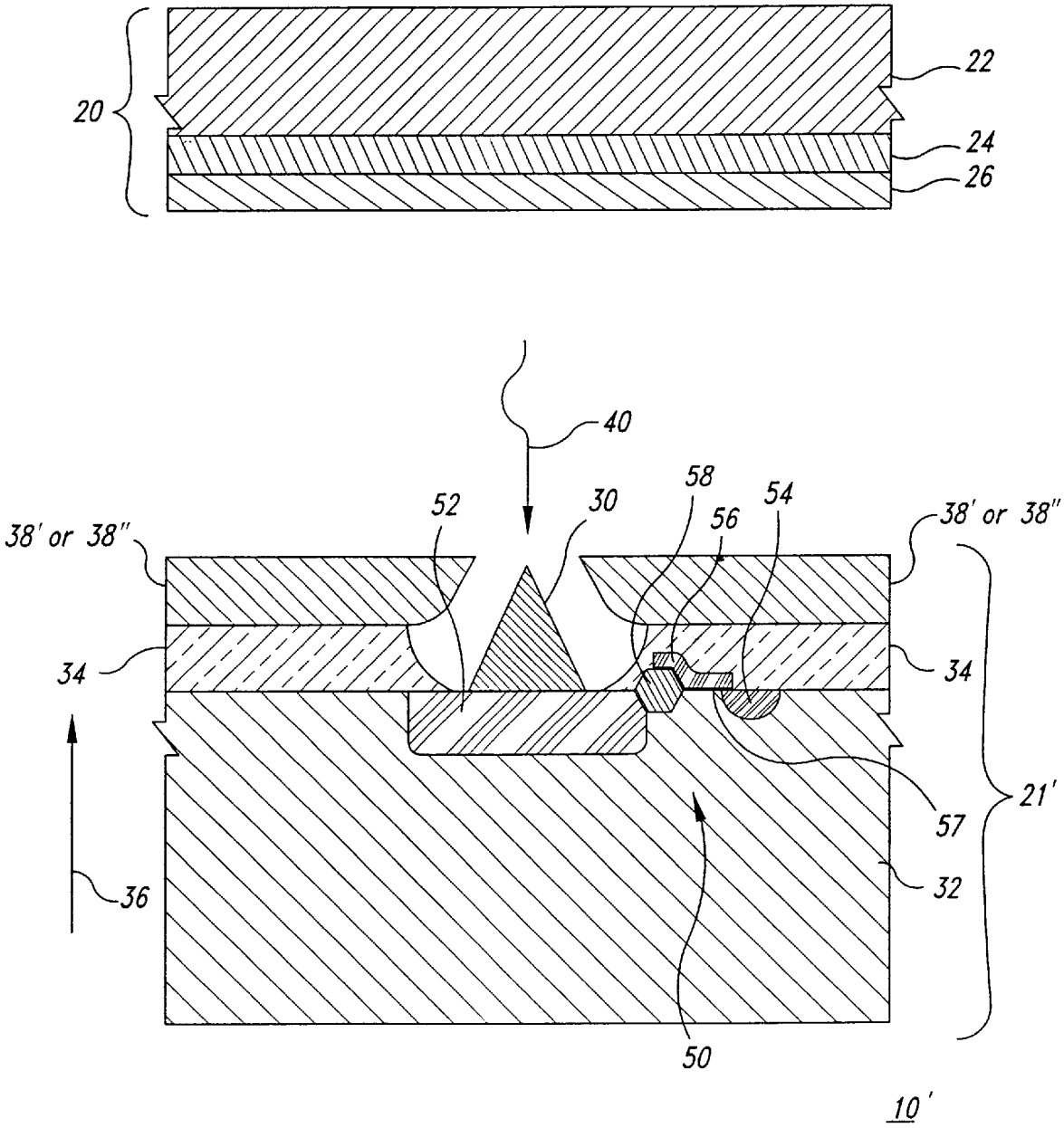
FIG. 2 is a simplified side cross-sectional view of a portion of a display according to an embodiment of the present invention.

FIG. 2 is a simplified side cross-sectional view of a portion of a display 10' in accordance with one embodiment of the invention. FIG. 2 is not drawn to scale. Many of the components used in the display 10' shown in FIG. 2 are identical to components used in the display 10 of FIG. 1. Therefore, in the interest of brevity, these components have been provided with the same reference numerals, and an explanation of them will not be repeated. Some of the elements shown in FIG. 1 are not repeated in FIG. 2 for clarity of representation.

When the extraction grid 38 of FIG. 1 is formed as a (e.g., ca. 0.1–0.2 micron) polysilicon layer, light that is incident on those portions of the extraction grid 38 that are exposed by the openings 40 in the high atomic mass layer 46, may penetrate the extraction grid 38. This leads to unwanted electron emission and results in distortion of images displayed on the display 10. The optical absorption coefficient $\alpha$ for silicon is about $10^4$/cm in the middle of the visible range. The attenuation factor (transmitted optical intensity I divided by incident optical intensity $I_o$) is found from the optical absorption coefficient $\alpha$ via $I=I_o e^{-\alpha x}$, where x is the thickness of the material through which the light is transmitted.

The optical absorption coefficient of germanium is about 50 times greater than the optical absorption coefficient of silicon. More specifically, the optical absorption coefficient for germanium is at least one order of magnitude greater than that of silicon over the entire visible range and approaches a value two orders of magnitude greater than that of silicon at the red end of the visible spectrum. It has been discovered that extraction grids 38' or 38" (FIG. 2) incorporating germanium layers are markedly more effective in blocking transmission of incident light in the visible range than are those layers consisting only of polysilicon layers of comparable thickness. Each 0.1 micron of germanium provides an attenuation factor of about $6.7\times10^{-3}$, which is more than two orders of magnitude more attenuation than that of silicon. In other words, less than one percent of the light that is incident on such layers is transmitted through these layers, compared to about 90% transmission for a comparable thickness of silicon. Baseplates 21' incorporating extraction grids 38' or 38" including germanium thus can be formed into displays 10' providing increased display dynamic range and reduced sensitivity to ambient light conditions than baseplates 21 (FIG. 1) that do not include germanium in the extraction grid 38. This is because much less of the light that is incident on the portions of the extraction grid 38' or 38" that are exposed to ambient light by the openings 40 can be transmitted through the extraction grid 38' or 38" to the n-tank 52 to give rise to optically-induced emission of electrons from the emitters 30.

Figure 3:
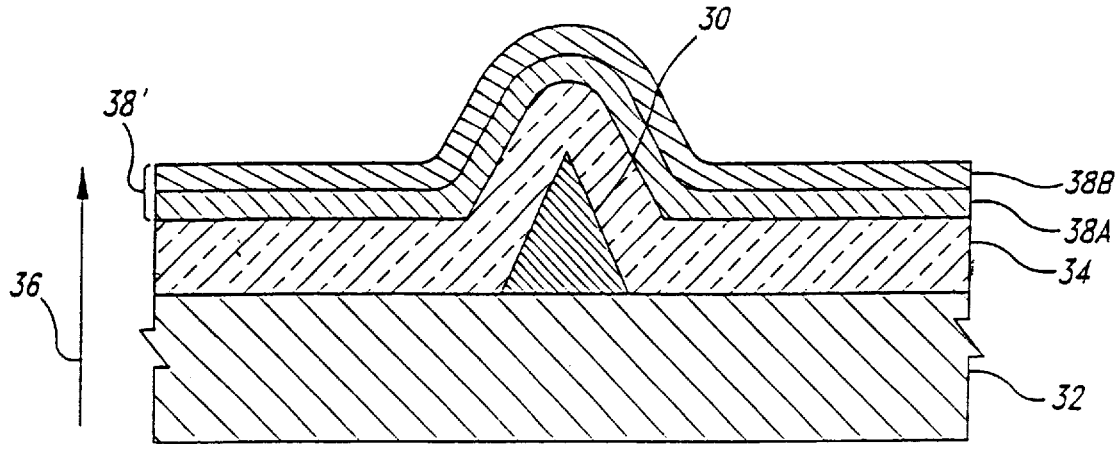
FIG. 3 is a simplified side cross-sectional view of a portion of an emitter and extraction grid assembly at one stage of fabrication according to an embodiment of the present invention.

FIG. 3 is a simplified side cross-sectional view of a portion of the emitter 30 and extraction grid 38' assembly at one stage in fabrication according to an embodiment of the present invention. In this embodiment, the extraction grid 38' is formed by a two layer structure fabricated on the dielectric layer 34. A first layer 38A may comprise polysilicon. A second layer 38B of germanium is formed on the first layer 38A. The first layer 38A is provided to chemically isolate the second layer 38B from the dielectric layer 34 to prevent the germanium in the second layer 38B from reacting with the oxygen that is present in the dielectric layer 34 when an oxide is used for this layer. A thickness of between 0.05 and 0.15 microns provides adequate chemical isolation of the second layer 38B from the dielectric layer 34. A thickness of between 0.1 and 0.2 microns for the second layer 38B provides both adequate conductivity and adequate light blocking characteristics. In one embodiment, the first layer 38A has a thickness of 0.1 micron measured along the direction indicated by direction arrow 36 and the second layer 38B has a thickness of 0.15 microns. Alternatively, a dielectric layer 34 could be used that is not an oxide, e.g., silicon nitride.

Typically, the second layer 38B is formed via plasma-enhanced chemical vapor deposition or low pressure chemical vapor deposition using germane ($GeH_4$) in a carrier gas such as helium, argon and/or hydrogen. If required, the second layer 38B may be patterned in conventional $CF_4$ or $SF_6$ plasmas. The second layer 38B may include amorphous or polycrystalline germanium.

Figure 4:
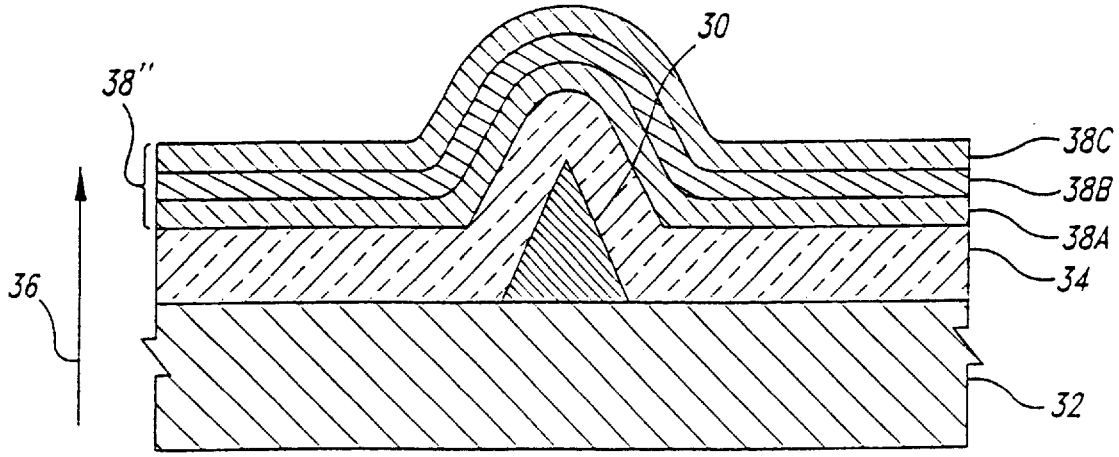
FIG. 4 is a simplified side cross-sectional view of a portion of an emitter and extraction grid assembly at one stage of fabrication according to another embodiment of the present invention.

FIG. 4 is a simplified side cross-sectional view of a portion of the emitter 30 and extraction grid 38" assembly at one stage in fabrication according to another embodiment of the present invention. In this embodiment, a third layer 38C of the extraction grid 38" is formed on the second layer 38B. The third layer 38C may also comprise polysilicon. In one embodiment, the third layer 38C has a thickness of 0.1 micron measured in the direction indicated by direction arrow 36. One reason that the third layer 38C might be desirable is to permit an oxide layer comprising the dielectric layer 42 (FIG. 1) to be formed on the extraction grid 38". This might be desirable and useful for electrically isolating the high atomic mass layer 46 (FIG. 1) from the extraction grid 38" by the dielectric layer 42 and for chemically isolating the second layer 38B from the dielectric layer 42. Alternatively, the embodiment of FIG. 3 could be used with a dielectric layer 42 that is not an oxide, e.g., silicon nitride.

In the embodiments of FIGS. 2 through 4, it is advantageous to design the doping of the layers 38A, 38B and optional layer 38C to provide a net sheet resistivity of between 500 and 5,000 ohms per square. In one embodiment, a sheet resistivity of 1,000 ohms per square is used. This sheet resistivity is low enough to allow the extraction grid 38' or 38" to provide the fields needed for field emission from the emitters 30, and is high enough to prevent a short circuit between any one emitter 30 and the extraction grid 38' or 38" from preventing the display 10' from functioning.

Figure 5:
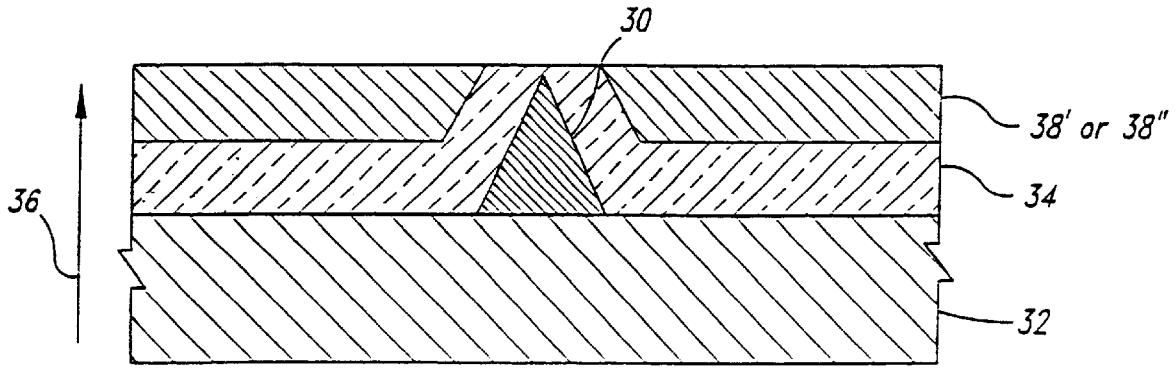
FIG. 5 is a simplified side cross-sectional view of a portion of the emitter and extraction grid assembly at a later stage of fabrication according to an embodiment of the present invention.

FIG. 5 is a simplified side cross-sectional view of a portion of the substrate 32, including the extraction grid 38' or 38" of FIGS. 3 or 4, after planarization of the extraction grid 38' or 38" and dielectric layer 34. Following deposition of the extraction grid 38' or 38", a conventional chemical-mechanical polish removes the "hill" comprising the dielectric layer 34 and extraction grid 38' or 38" immediately above the tip of the emitter 30. This is typically carried out via a potassium hydroxide solution that incorporates suspended particles of controlled size, which may be silicon particles. It is important that the chemical-mechanical polish not damage the tip of the emitter 30, i.e., that the polishing process stops short of reaching this tip.

Figure 6:
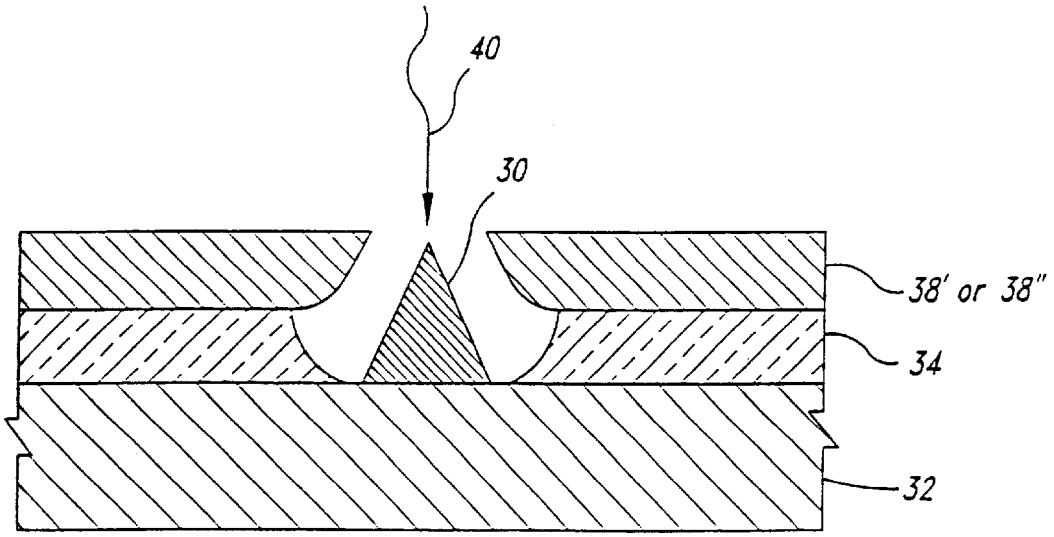
FIG. 6 is a simplified side cross-sectional view of a portion of the emitter and extraction grid assembly at a still later stage of fabrication according to an embodiment of the present invention.

FIG. 6 is a simplified side cross-sectional view of a portion of the emitter 30 and extraction grid 38' or 38" that illustrates the result of etching the structure of FIG. 5. Following the chemical-mechanical polishing operation, the extraction grid 38' or 38" may be used as a mask for etching of the dielectric layer 34 to expose at least the tips of the emitters 30 in the openings 40. This has the advantage of not requiring another cycle of photoresist application, exposure and development. This reduces labor content and materials requirements and also promotes increased yields by reducing the number of processing steps. When silicon dioxide is used to form the dielectric layer 34, this step is usefully carried out by etching the dielectric layer 34 in buffered oxide etch ("BOE"), a conventional buffered aqueous hydrogen fluoride etch solution.

When the dielectric layer 34 is etched with BOE using the extraction grid 38' or 38" as an etch mask, it is important that the etch rate for the dielectric layer 34 be substantially higher than the etch rate for the extraction grid 38' or 38". Germanium and silicon are both substantially unaffected by exposure to BOE and thus are both well suited for forming the extraction grid 38' or 38".

Aluminum and titanium are both etched by BOE, for example. BOE does not etch tungsten, but tungsten does not adhere well to silicon dioxide, which is often used to form the dielectric layer 34. As a result, a metallurgically compatible adhesion-promoting layer is required between tungsten and the dielectric layer 34, such as titanium. Chromium resists etching by BOE, but reacts chemically with silicon dioxide. Germanium in the extraction grid 38' or 38" provides light-blocking capability together with chemical compatibility.

Figure 7:
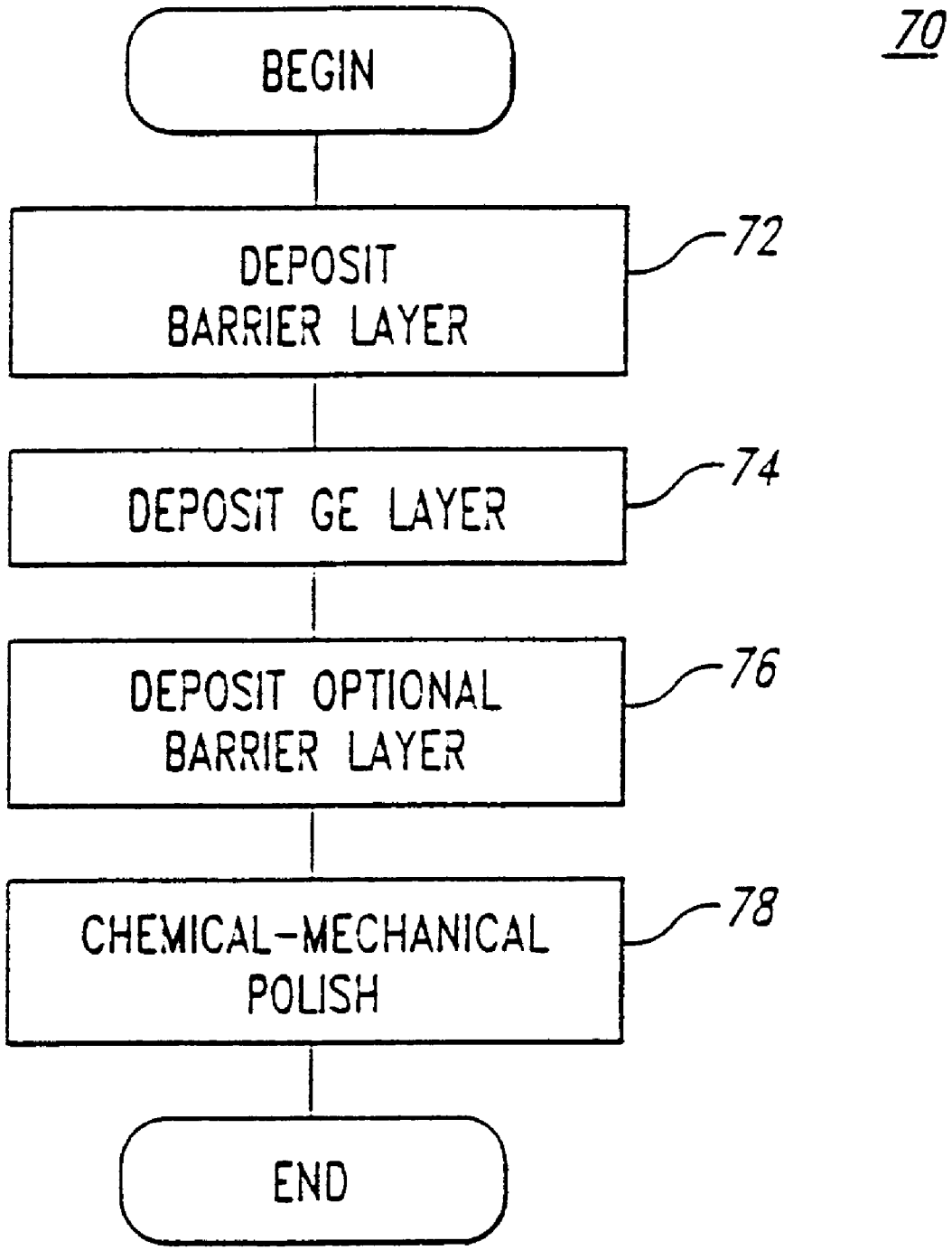
FIG. 7 is a flow chart of a process for fabricating emitter and extraction grid assemblies according to an embodiment of the present invention.

FIG. 7 is a flowchart of a process 70 for fabricating the emitter 30 and extraction grid 38' or 38" assemblies of FIGS. 2 through 6 according to an embodiment of the present invention. The substrate 32 having a plurality of the emitters 30 has been previously formed, and the surface of the substrate 32 and the emitters 30 have been previously coated with the dielectric layer 34. The process 70 begins in step 72 by forming the first layer 38A (see FIGS. 3 and 4) on the dielectric layer 34. In step 74, the second layer 38B comprising germanium is formed on the barrier layer 38A. In step 76, the third layer 38C (see FIG. 4) may be formed on the second layer 38B. In step 78, chemical-mechanical polishing is used to remove those portions of the dielectric layer 34, and the layers comprising the extraction grid 38' or 38", that are immediately above the emitters 30, to provide the structure shown in FIG. 5. The process 70 then ends and the display 10' is subsequently completed via conventional fabrication steps.

Figure 8:
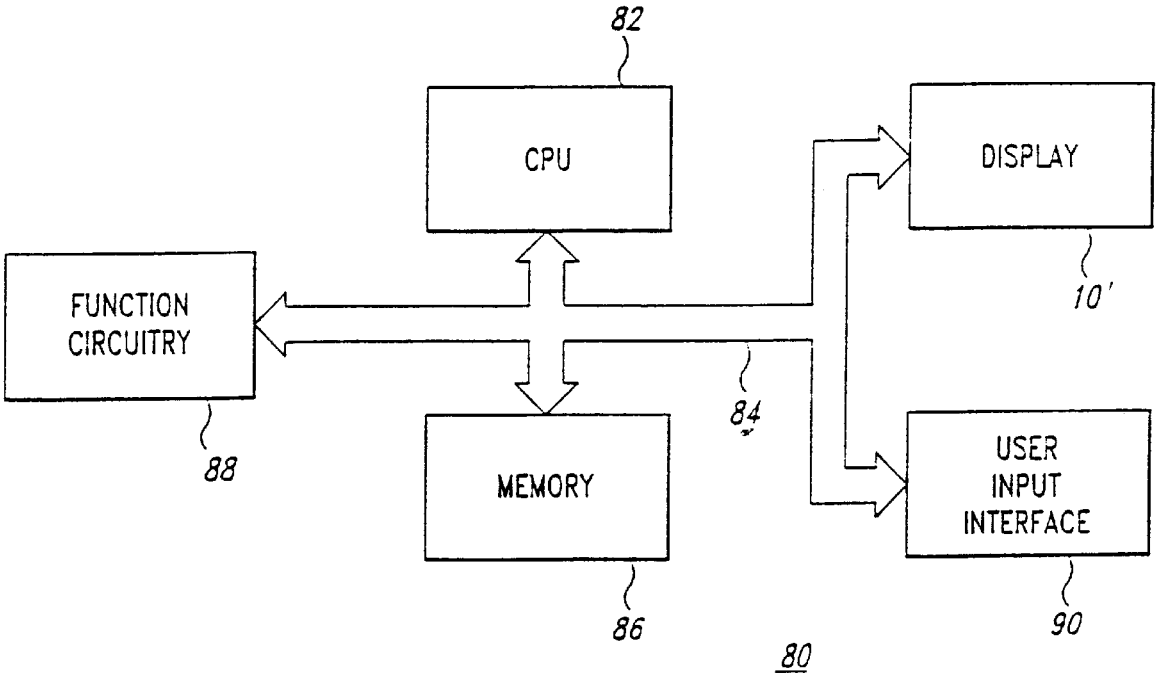
FIG. 8 is a simplified block diagram of a computer using the extraction grid assembly according to an embodiment of the present invention.

FIG. 8 is a simplified block diagram of a portion of a computer 80 using the display 10' fabricated as described with reference to FIGS. 2 through 7 and associated text. The computer 80 includes a central processing unit 82 coupled via a bus 84 to a memory 86, function circuitry 88, a user input interface 90 and the display 10' including the second layer 38B comprising germanium according to the embodiments of the present invention. The memory 86 may or may not include a memory management module (not illustrated) and does include ROM for storing instructions providing an operating system and a read-write memory for temporary storage of data. The processor 82 operates on data from the memory 86 in response to input data from the user input interface 90 and displays results on the display 10'. The processor 82 also stores data in the read-write portion of the memory 86. Examples of systems where the computer 80 finds application include personal/portable computers, camcorders, televisions, automobile electronic systems, microwave ovens and other home and industrial appliances.

Field emission displays 10' for such applications provide significant advantages over other types of displays, including reduced power consumption, improved range of viewing angles, better performance over a wider range of ambient lighting conditions and temperatures and higher speed with which the display can respond. Field emission displays 10' find application in most devices where, for example, liquid crystal displays find application.

An improved extraction grid 38' or 38" for the display 10' having improved optical isolation properties has been described. The extraction grid 38' or 38" is not significantly larger than conventional extraction grids 38 and does not require additional photolithographic steps. Increased optical isolation of the emitter 30 and any p-n junctions in the immediate vicinity of the emitter 30 lead to improvements in display dynamic range and reduced distortion in displays 10'.

Although the present invention has been described with reference to specific embodiments, the invention is not limited to these embodiments. Rather, the invention is limited only by the appended claims, which include within their scope all equivalent devices or methods which operate according to the principles of the invention as described.

What is claimed is:

1. A method for making a field emission display baseplate, the method comprising:

forming a plurality of emitters on a substrate;

forming a dielectric layer on the substrate, the dielectric layer having a plurality of openings each of which surrounds a respective one of the emitters; and forming a layer of germanium on the dielectric layer, the germanium layer having a plurality of openings each of which surrounds a respective one of the emitters.

2. The method of claim 1 wherein:

forming a dielectric layer comprises forming a dielectric layer on the planar surface and the plurality of emitters; and forming a conductive layer comprises:

forming a first layer including polysilicon on the dielectric layer;

forming a second layer including germanium on the first layer; and forming a third layer including polysilicon on the second layer.

3. The method of claim 1, further comprising:

treating the dielectric layer and the conductive layer to remove at least those portions of the dielectric layer and the conductive layer directly above tips of the plurality of emitters to provide a plurality of openings in the conductive layer each concentric with a tip of one of the plurality of emitters; and etching the dielectric layer to expose at least tips of the plurality of emitters.

4. The method of claim 3 wherein the treating step comprises polishing the conductive layer and the dielectric layer via a chemical-mechanical polishing process.

5. The method of claim 1, further comprising placing a faceplate in a plane parallel to a plane of tips of the plurality of emitters, the faceplate comprising a cathodoluminescent layer formed on a transparent conductive layer in turn formed on a transparent insulator.

6. The method of claim 1 wherein forming a plurality of emitters on a substrate includes forming a plurality of emitters on a substrate wherein each of the plurality of emitters forms a drain of a FET in an active display.

7. The method of claim 1 wherein forming a layer of germanium includes forming a layer of polycrystalline germanium.

8. The method of claim 1 wherein forming a layer of germanium includes forming a layer of amorphous germanium.

* * * * *